US007753210B2

(12) United States Patent
Horio

(10) Patent No.: US 7,753,210 B2
(45) Date of Patent: Jul. 13, 2010

(54) DAMPER SYSTEM FOR TRANSPORTATION OF A CONTAINER

(75) Inventor: Tomohiro Horio, Tokyo (JP)

(73) Assignee: SUMCO Corporation, Tokyo (JP)

( * ) Notice: Subject to any disclaimer, the term of this patent is extended or adjusted under 35 U.S.C. 154(b) by 82 days.

(21) Appl. No.: 12/216,012

(22) Filed: Jun. 27, 2008

(65) Prior Publication Data

US 2008/0296200 A1 Dec. 4, 2008

Related U.S. Application Data

(63) Continuation-in-part of application No. 10/853,137, filed on May 26, 2004, now abandoned.

(30) Foreign Application Priority Data

Jul. 24, 2003 (JP) ..... 2003-200935

(51) Int. Cl.
*B65D 81/05* (2006.01)

(52) U.S. Cl. ..... 206/586; 206/523; 206/588; 206/592

(58) Field of Classification Search ..... 206/320, 206/523, 583, 586–592, 594; 53/472
See application file for complete search history.

(56) References Cited

U.S. PATENT DOCUMENTS 2,860,768 A 11/1958 Smithers
3,946,874 A 3/1976 Breth et al.
4,240,240 A 12/1980 Cohen
5,259,508 A 11/1993 Beckerman
5,271,499 A 12/1993 Van Horssen
5,366,080 A 11/1994 Carstersen et al.
5,755,331 A 5/1998 Watson
5,806,286 A 9/1998 Oinuma et al.
6,588,595 B2 7/2003 Levin et al.
6,817,161 B1 11/2004 Wu et al.
6,915,905 B2 7/2005 Yoshimura
7,341,152 B2 * 3/2008 Yoshimura ..... 206/521

FOREIGN PATENT DOCUMENTS

JP 2000-208602 7/2000
JP 2002-160769 6/2002
JP 2002-274572 9/2002
JP 2003-026232 1/2003

* cited by examiner

*Primary Examiner*—Bryon P Gehman
(74) *Attorney, Agent, or Firm*—Bacon & Thomas, PLLC

(57) ABSTRACT

A damper system for transportation includes a packaging box for storing a container containing a work and also includes a pair of an upper damper and a lower damper each placed between the packaging box and the container. The upper and lower dampers contain foamed polyethylene or polypropylene, the upper damper includes upper impact-absorbing sections, and the lower damper includes lower impact-absorbing sections. The sum of h2 and h1 is equal to the width of an upper or lower space between the packaging box and the container, and h1 is greater than h2, wherein h2 represents the height of the upper impact-absorbing sections and h1 represents the height of the lower impact-absorbing sections. The shape of the upper and lower impact-absorbing sections is rectangular parallelepiped shape.

7 Claims, 6 Drawing Sheets

FIG.5b
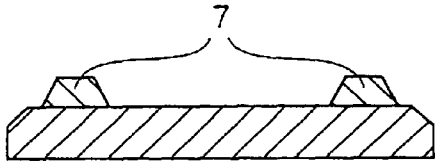
FIG.5a
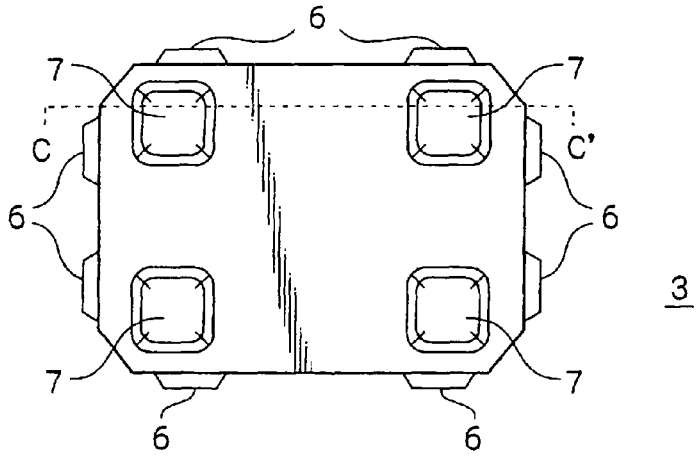
FIG.6b
FIG.6a
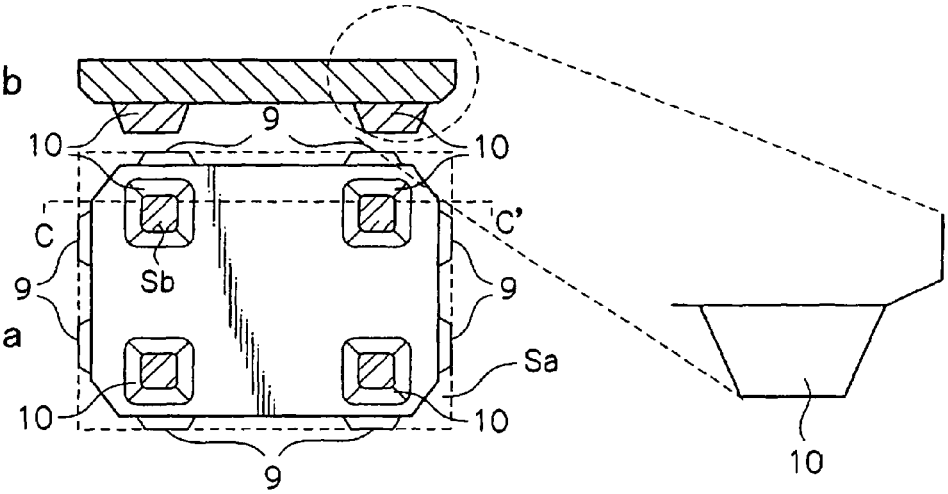

DAMPER SYSTEM FOR TRANSPORTATION OF A CONTAINER

CROSS-REFERENCE TO RELATED APPLICATION

This application is a continuation-in-part of U.S. application Ser. No. 10/853,137 filed May 26, 2004 (now abandoned) and claims, under 35 USC 119, priority of Japanese Application No. 2003-200935 filed Jul. 24, 2003. The teachings of said U.S. and Japanese applications are incorporated by reference herein in their entireties, inclusive of their specifications, claims and drawings.

BACKGROUND OF THE INVENTION

1. Field of the Invention

The present invention relates to packaging systems for transporting containers principally storing circular works such as semiconductor wafers or magnetic disks. The present invention particularly relates to a damper system for transportation. The damper system includes a packaging box, such as a corrugated fiberboard box, for storing a container containing a work and also includes a pair of upper and lower dampers placed between the container and the packaging box. The dampers absorb impact applied from outside, whereby the container and the work placed therein are prevented from being damaged.

2. Description of the Related Art

FIG. 4 shows a known damper system for transporting semiconductor wafers or recording disks. The known damper system includes a packaging box 1 including a corrugated fiberboard; a lower damper 2, placed on a bottom section of the packaging box 1, having a recessed retaining portion 4; a container 5, made of plastic or resin, storing several tens of semiconductor wafers or recording disks; and an upper damper 3 placed on the container 5. The container 5 is retained with the recessed retaining portion 4 in a fitted manner and placed between the lower damper 2 and the upper damper 3. The packaging box 1 is sealed with staples or a strip of adhesive tape. Therefore, the container 5 is protected from impact applied from outside during the transportation thereof and therefore prevented from being injured or damaged, and the semiconductor wafers or the recording disks placed in the container 5 are also prevented from being injured or damaged.

The lower and upper dampers 2 and 3 principally include a molded article made of a thin plastic sheet; a foam-molded article made of polyethylene, polypropylene, or polyurethane; or a laminated corrugated fiberboard. Those materials can be readily distorted by impact and cannot be readily restored to their former state; hence, the lower and upper dampers 2 and 3, once distorted, cannot absorb impact continuously applied thereto.

Japanese Unexamined Patent Application Publication No. 2000-208602 discloses a shipping box that is partly reusable and hardly propagates impact. The shipping box is made of metal and includes a cushioning material placed therein. However, the shipping box is not suitable for practical use because the usage cost is high unless the box is fully reused.

On the other hand, large-diameter semiconductor wafers with a diameter of 300 mm have a weight at least twice greater than that of known semiconductor wafers with a diameter of 200 mm. Therefore, containers for storing the large-diameter semiconductor wafers have a large weight. Increase in the diameter of semiconductor wafers causes a decrease in the strength of the wafers; hence, a slight impact that does not cause damage in the 200 mm wafers during the transportation causes serious damage in the 300 mm wafers during the transportation in some cases.

For example, Japanese Unexamined Patent Application Publication No. 2002-160769 discloses a bellows, which is one of dampers for containers that do not cause an increase in the volume or size of packages and absorb impact, the bellows being made of a molded sheet containing polypropylene or polyethylene. However, the bellows has an insufficient ability to absorb impact and cannot therefore be used for transporting the 300 mm wafers.

In general, molded plastic sheets and laminated corrugated fiberboards used in known techniques have low resilience. Therefore, once the sheets and the fiberboards receive a strong impact, they are distorted and cannot function as dampers. Dampers made of foamed polyurethane can be restored to its former state if the dampers receive impact. However, in the dampers, there is a problem in that poisonous gas is generated when the dampers discarded are burned.

The inventors have investigated the ability to absorb impact, the resilience, and the disposal problem, found that foamed polyethylene and polypropylene are the best materials for forming dampers, and then developed a new type of damper that is suitable for transporting a large-diameter semiconductor wafer with a diameter of 300 mm.

Dampers containing foamed polyethylene or polypropylene will now be described with reference to FIGS. 4, 5, and 6. FIG. 5*a* is a plan view showing an upper damper 3 and FIG. 5*b* is a sectional view showing the upper damper 3 taken along the line C-C' of FIG. 5*a*. FIG. 6*a* is a plan view showing a lower damper 2 and FIG. 6*b* is a sectional view showing the lower damper 2 taken along the line C-C' of FIG. 6*a* and a portion of the lower damper 2 in an enlarged manner.

The upper damper 3 includes eight first impact-absorbing sections 6 and four upper impact-absorbing sections 7. The front, rear, right, and left faces of the upper damper 3 each have two of the eight first impact-absorbing sections 6 thereon and the upper face of the upper damper 3 has the upper impact-absorbing sections 7 each placed at corresponding predetermined regions (regions each corresponding to the corners of a container 5) each located close to the four corners of the upper face. When impact is applied to the upper damper 3 in a direction, some of the first impact-absorbing sections 6 and upper impact-absorbing sections 7 are pressed and thereby distorted, whereby the applied impact is absorbed. The upper damper 3 has a container-retaining section, lying over the container 5 with a size specified in the SEMI standard (M31), for retaining each of various types of containers. The lower damper 2 as well as the upper damper 3 include eight second impact-absorbing sections 9 and four lower impact-absorbing sections 10. The front, rear, right, and left faces of the lower damper 2 each have two of the eight second impact-absorbing sections 9 thereon and the lower face of the lower damper 2 has the lower impact-absorbing sections 10 each placed at corresponding predetermined regions (regions each corresponding to the corners of the container 5) each located close to the four corners of the lower face. When impact is applied to the lower damper 2 in a direction, some of the second impact-absorbing sections 9 and lower impact-absorbing sections 10 are pressed and thereby distorted, whereby the applied impact is absorbed.

The upper and lower impact-absorbing leg sections 7 and 10 have the same height and shape, trapezoidal, the height of the upper impact-absorbing leg sections 7 being represented by h1 and that of the lower impact-absorbing leg sections 10 being represented by h2. Therefore, when a strong impact is applied to the lower and upper dampers 2 and 3 in the lower direction, the lower and upper dampers 2 and 3 cannot sufficiently absorb the impact.

SUMMARY OF THE INVENTION

In view of the foregoing circumstances, the present invention has been made to enhance the ability to absorb impact and the resilience and made to cope with the disposal problem. It is an object of the present invention to provide a damper system for transporting a semiconductor wafer or the like. The damper system protects a product, stored in a container placed in a packaging box having a predetermined size, from a strong impact applied to the packaging box particularly in the lower direction during the transportation of the product.

In order to achieve the above object, a damper system for transportation according to the present invention includes a packaging box storing a container containing work products in a vertical state to be protected from damage upon impact; a lower damper, located in a lower space between lower surfaces of the packaging box and container, the lower damper having a lower body portion and lower impact-absorbing leg sections, wherein the lower body portion has upper and lower surfaces and four side surfaces defining four corners of the lower body portion and wherein the lower impact-absorbing leg sections are respectively located at the four corners of the lower body portion and extend a distance h1 from the lower surface of the lower body portion toward the lower surface of the packaging box; and an upper damper, located in an upper space between upper surfaces of the packaging box and container, the upper damper having an upper body portion and upper impact-absorbing leg sections, wherein the upper body portion has upper and lower surfaces and four side surfaces defining four corners of the upper body portion and wherein the upper impact-absorbing leg sections are respectively located at the four corners of the upper body portion and extend a distance h2 from the upper surface of the upper body portion toward the upper surface of the packaging box; and wherein h1 is greater than h2 and the lower damper has an opening, which penetrates the lower damper, for distributing impact, applied from the outside, to the lower impact-absorbing leg sections, the opening being centered relative to the lower damper, the upper damper has an opening, which penetrates the upper damper, for distributing impact, applied from the outside, to the upper impact-absorbing leg sections, the opening being centered relative to the upper damper, and the area of the opening centered relative to the upper damper is larger than the area of the opening centered relative to the lower damper.

In the damper system according to the present invention, it is preferable that the opening has a cross-section defined by four interior side walls respectively parallel to the four side surfaces of the lower damper, and wherein a dimension of the rectangle, extending between two of the interior side walls opposing each other, is greater than the distance on the lower surface of the lower damper between two of the leg sections on the lower damper.

In addition, it is preferable that the opening has a cross-section defined by four interior side walls respectively parallel to the four side surfaces of the upper damper, and wherein a dimension of the rectangle, extending between two of the interior side walls opposing each other, is greater than the distance on the upper surface of the lower damper between two of the leg sections on the upper damper.

It is also preferable that the area of the opening centered relative to the upper damper is set to 2.5 to 3.5 times as much as the area of the opening centered relative to the lower damper.

In addition, the damper system for transportation according to the present invention includes a packaging box for storing a container containing a work and also includes a pair of an upper damper and a lower damper each placed between the packaging box and the container. The upper and lower dampers contain foamed polyethylene or polypropylene. The upper damper includes upper impact-absorbing sections and the lower damper includes lower impact-absorbing sections. The sum of h2 and h1 is equal to the width of an upper or lower space between the packaging box and the container, and h1 is greater than h2, where h2 represents the height of the upper impact-absorbing sections and h1 represents the height of the lower impact-absorbing sections.

In the damper system, h1 is within a range of 4 to 5 cm and h2 is within a range of 0.5 to 1.5 cm.

In the damper system, the lower impact-absorbing sections have a rectangular parallelepiped shape.

In the damper system, the lower damper has an opening for distributing impact, applied from outside, to the lower impact-absorbing sections, the opening being located at the center of the lower damper.

In the damper system, the percentage of Sb to Sa is within a range of 3% to 5%, wherein Sa represents the area of the upper or lower face of the packaging box and Sb represents the area of each of contact portions between the packaging box and the upper impact-absorbing sections or the lower impact-absorbing sections.

Since the upper and lower dampers contain foamed polyethylene or polypropylene and the height of the lower impact-absorbing sections is greater than that of the upper impact-absorbing sections, the damper system absorbs impact applied in the lower direction and the container or semiconductor wafers placed in the container can therefore be prevented from being damaged if the damper system is dropped from the top of triple-stacked cargo or dropped at a height of 1.5 m or more during the transportation.

The lower impact-absorbing sections have a rectangular parallelepiped shape, whereas known impact-absorbing sections have a trapezoidal shape. Therefore, when a strong impact is applied to the impact-absorbing sections, the impact-absorbing sections are uniformly distorted, whereby the impact is efficiently absorbed. Furthermore, the lower damper has the opening located at the center thereof, whereby the contact area between the container and the lower damper is minimized and an applied impact is distributed. Therefore, the damper system has a high ability to absorb impact.

The lower impact-absorbing sections preferably have a height of 4 to 5 cm. When the height is less than 4 cm, the impact-absorbing ability is low. In contrast, when the height is more than 5 cm, the upper impact-absorbing sections have an insufficient height because the packaging box has a predetermined size. Thus, the height of the lower impact-absorbing sections is preferably 4 to 5 cm in consideration of the minimum height of the upper impact-absorbing sections. The damper system preferably has a recessed portion so as to retain various types of containers specified in the SEMI standard.

Since the lower damper has the opening located at the center thereof, impact applied from outside is distributed to the lower impact-absorbing sections because the impact is prevented from being propagated to the opening. Therefore, the lower impact-absorbing sections absorb the impact and the semiconductor wafers in the container are prevented from being damaged.

When the upper impact-absorbing sections have such a size that an upper space between the container and the packaging box is occupied with the upper impact-absorbing sections or the lower impact-absorbing sections have such a size that a lower space between the container and the packaging box is occupied with the lower impact-absorbing sections, the upper and lower impact-absorbing sections are not distorted by impact applied from outside and the impact is directly propagated to the container. In contrast, when the contact portions between the packaging box and the upper impact-absorbing sections or the lower impact-absorbing sections have an extremely small area, the upper and lower impact-absorbing sections cannot endure impact and are therefore buckled, that is, the upper and lower dampers do not function well. Thus, the percentage of Sb to Sa is preferably within a range of 3% to 5% in view of the above.

BRIEF DESCRIPTION OF THE DRAWINGS

FIG. 5*a* is a plan view showing a known upper damper;

FIG. 5*b* is a sectional view showing the known upper damper taken along the line C-C' of FIG. 5*a;*

FIG. 6*a* is a plan view showing a known lower damper;

FIG. 6*b* is a sectional view showing the known lower damper taken along the line C-C' of FIG. 6*a* and a portion of the known lower damper in an enlarged manner;

DESCRIPTION OF THE PREFERRED EMBODIMENTS

Figure 1:
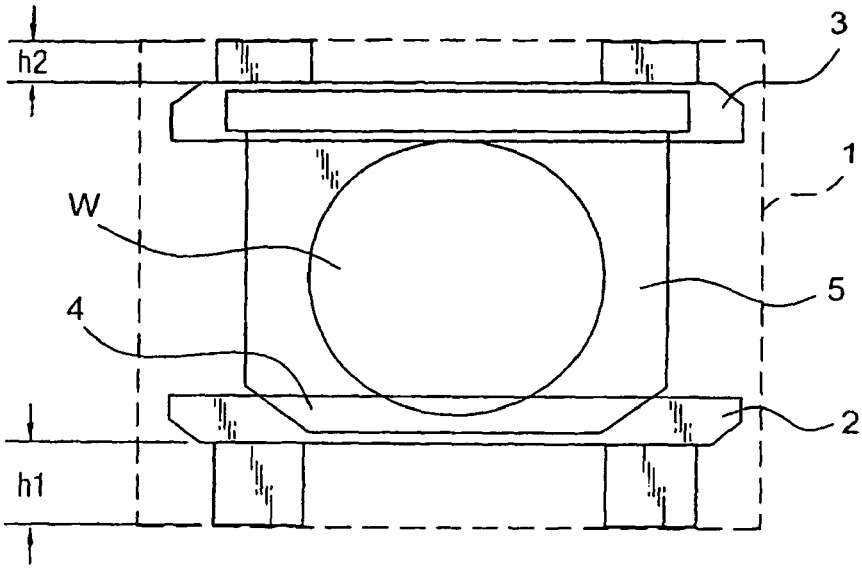
FIG. 1 is a sectional view showing a damper system of the present invention.

A damper system for transportation according to an embodiment of the present invention will now be described with reference to the accompanying drawings. Since the damper system of this embodiment has substantially the same configuration as that of the known damper system described above, the same components have the same reference numerals and descriptions of the components are omitted. In this embodiment, the damper system is described using a system, used for transporting a container containing a semiconductor wafer, as an example. The damper system includes a packaging box 1 and a pair of a lower damper 2 and an upper damper 3.

Figure 4:
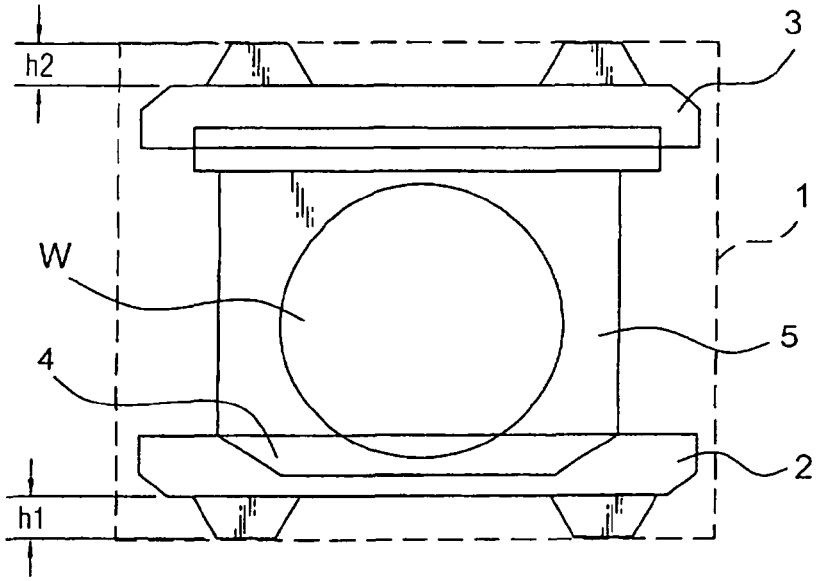
FIG.4 (PRIOR ART)
FIG. 4 is a sectional view showing a known damper system.

With reference to FIG. 1, a container 5 vertically stores semiconductor wafers W, for example, 25 silicon wafers, having a diameter of 300 mm, prepared according to the following procedure: a silicon ingot prepared by the Czochralski process is shaped into a block having a predetermined size, the block is sliced into sheets, and the sheets are chamfered, lapped, etched, and then polished. Other components shown in FIG. 5 are substantially the same as those shown in FIG. 4 and have the same reference numerals as those shown in FIG. 4, and descriptions of the components are omitted.

The upper damper 3 includes eight first impact-absorbing sections 6 and four upper impact-absorbing leg sections 7A. The front, rear, right, and left faces of the upper body portion (3) of the upper damper 3 each have two of the eight first impact-absorbing sections 6 thereon and the upper face of the upper body portion (3) has the upper impact-absorbing leg sections 7A each placed at corresponding predetermined regions (regions each corresponding to the corners of the container 5) each located close to the four corners of the upper face. When impact is applied to the upper damper 3 in a direction, some of the first impact-absorbing sections 6 and upper impact-absorbing leg sections 7A are pressed and thereby distorted, whereby the applied impact is absorbed. The upper impact-absorbing leg sections 7A have a rectangular parallelepiped shape and a height of 0.5 to 1.5 cm, the height being represented by h2.

The upper damper 3 has a container-retaining section, lying over the container 5 with a size specified in the SEMI standard (M31), for retaining each of various types of containers.

The upper damper 3 has a first penetrating opening 8 located at the center thereof. The first opening 8 allows the upper damper 3 to be in contact only with outer portions of the container 5. According to such a configuration, impact applied to the upper damper 3 in the upper direction is distributed to the outer portions and the upper impact-absorbing leg sections 7A, and only the upper impact-absorbing leg sections 7A are distorted, whereby the impact is absorbed. Therefore, the semiconductor wafers W placed in the container 5 are protected from the impact. Furthermore, the first opening 8 allows observers to confirm if there is the container 5 in the packaging box 1 and to see a label or the like placed on the upper face of the container 5.

The lower damper 2 as well as the upper damper 3 include eight second impact-absorbing sections 9 and four lower impact-absorbing leg sections 10A. The front, rear, right, and left faces of the lower body portion (2) of the lower damper 2 each have two of the eight second impact-absorbing sections 9 thereon and the lower body portion (2) of the lower damper 2 has the lower impact-absorbing leg sections 10A each placed at corresponding predetermined regions (regions each corresponding to the corners of the container 5) each located close to the four corners of the lower face. The height of the lower impact-absorbing leg sections 10A is greater than that of the upper impact-absorbing leg sections 7A. When impact is applied to the lower damper 2 in a direction, some of the second impact-absorbing sections 9 and lower impact-absorbing leg sections 10A are pressed and thereby distorted, whereby the applied impact is absorbed. The lower impact-absorbing leg sections 10A have a rectangular parallelepiped shape and a height of 4 to 5 cm, the height being represented by h1. When a strong impact is applied to the lower impact-absorbing leg sections 10A, the lower impact-absorbing leg sections 10A are therefore uniformly distorted and absorb the impact slowly, whereby the semiconductor wafers W placed in the container 5 are prevented from being damaged. The upper face of the lower damper 2 has a recessed portion of which the bottom is flat and which is in contact only with a lower portion of the container 5. The weight of the container 5 is applied only to the lower portion thereof. When impact is applied to the lower damper 2 in the lower direction, only the lower impact-absorbing leg sections 10A are distorted, whereby the impact is absorbed.

The lower damper 2 has a second penetrating opening 11 located at the center thereof. The second opening 11 has the same function as that of the first opening 8. That is, the second opening 11 allows the lower damper 2 to be in contact only with outer portions of the container 5. According to such a configuration, impact applied to the lower damper 2 in the lower direction is distributed to the outer portions and the lower impact-absorbing leg sections 10A, and only the lower impact-absorbing leg sections 10A are distorted, whereby the impact is absorbed. When the lower impact-absorbing leg sections 10A are distorted due to the applied impact, the second opening 11 prevents the upper face of the lower damper 2 from being in contact with the lower face of the container 5; whereby the impact is prevented from being applied to the whole lower face of the container 5. The percentage of Sb to Sa is preferably within a range of 3% to 5% and more preferably 4%, wherein Sa represents the area of the upper or lower face of the packaging box 1 and Sb represents the area of each of contact portions between the packaging box 1 and the upper impact-absorbing leg sections 7A or the lower impact-absorbing leg sections 10A.

Figure 2B:
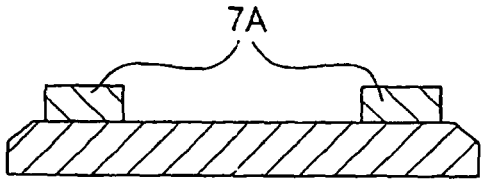
FIG. 2*b* is a sectional view showing the upper damper taken along the line C-C' of FIG. 2*a;*
Figure 2A:
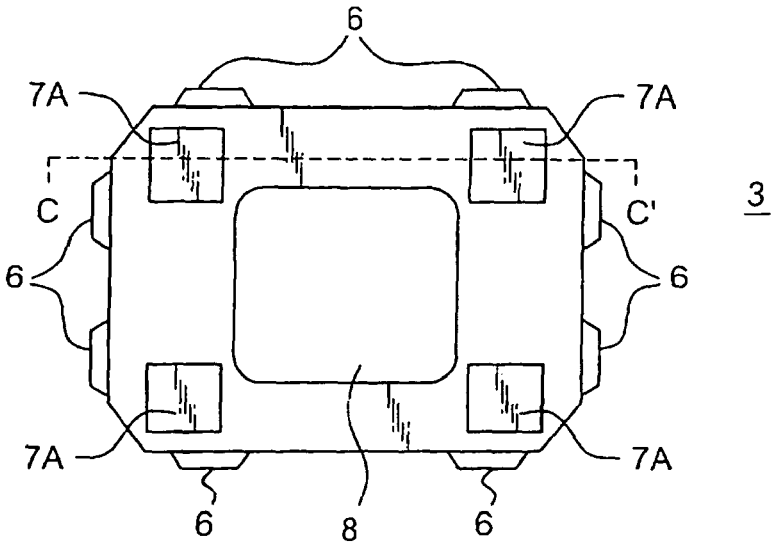
FIG. 2*a* is a plan view showing an upper damper according to the present invention.
Figure 3B:
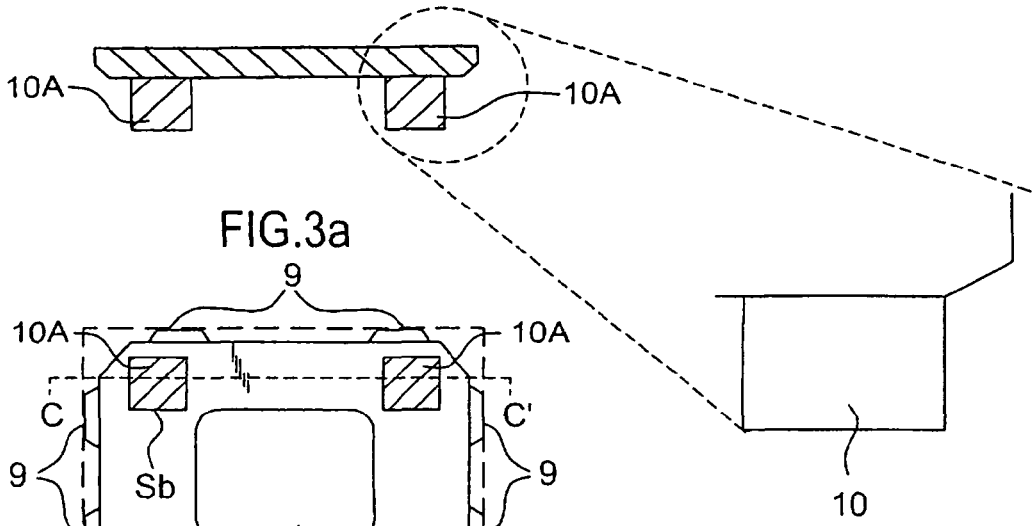
FIG. 3*b* is a sectional view showing the lower damper taken along the line C-C' of FIG. 3*a* and a portion of the lower damper in an enlarged manner.
Figure 3A:
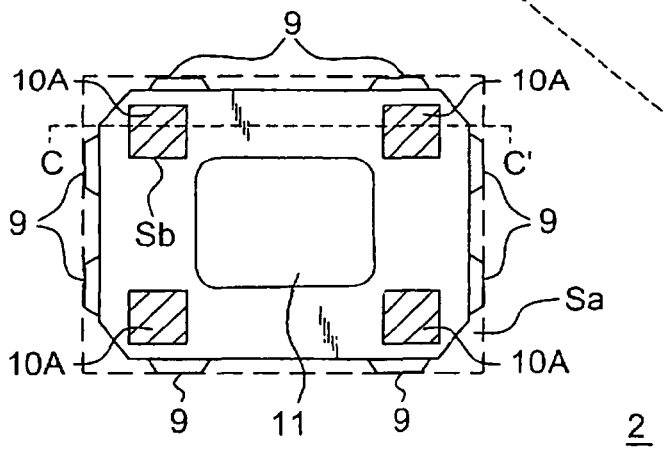
FIG. 3*a* is a plan view showing a lower damper according to the present invention.

Further, as shown in FIGS. 2 and 3, the area of the opening 8 centered relative to the upper damper 3 is set to be larger than the area of the opening 11 centered relative to the lower damper 2.

When the packaging box 1 which stores a container 5 drops, one case is that the packaging box 1 drops as it is (not upside down) and the bottom of the packaging box 1 may receive impact. Another case is that the packaging box 1 drops upside down and the upper surface of the packaging box 1 may receive impact. At this time, impact propagated to the container decrease as (1) lengths of impact-absorbing leg sections 7A and 10A are longer and (2) areas of the openings 8 and 11 centered relative to the damper are larger.

Figure 9:
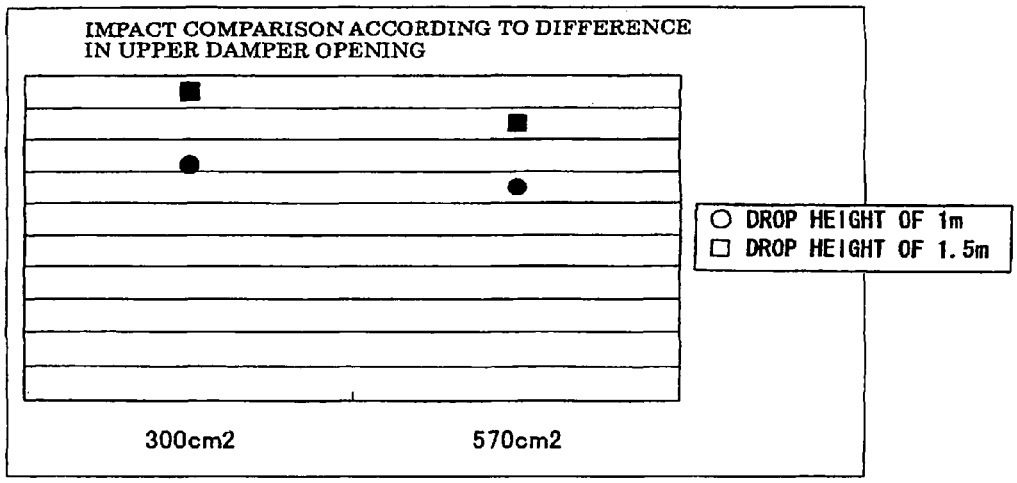
FIG. 9 is a graph showing impact comparison values determined in a drop test in which an area of an opening of the upper damper is 300 $cm^2$ and an area of an opening of the upper damper is 570 $cm^2$.
Figure 10:
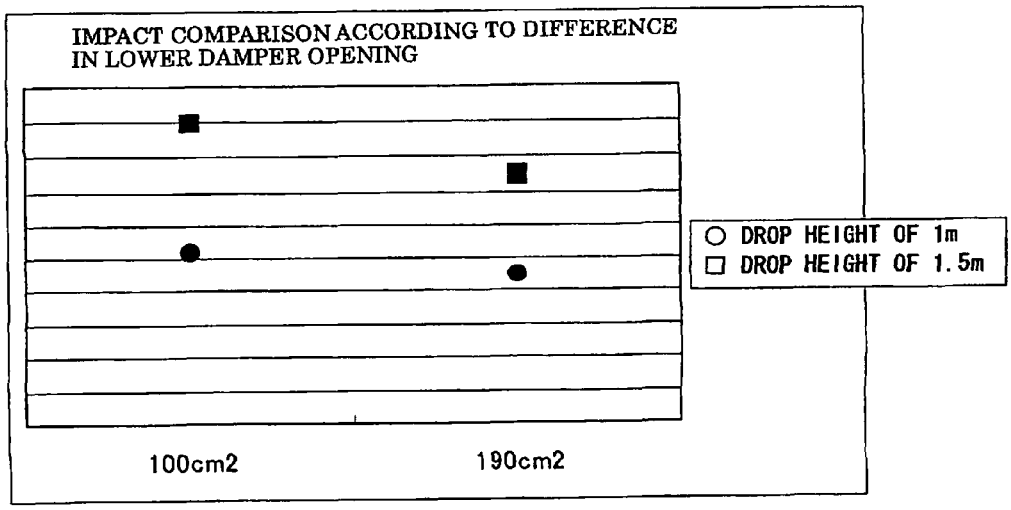
FIG. 10 is a graph showing impact comparison values determined in a drop test in which an area of an opening of the lower damper is 100 $cm^2$ and an area of an opening of the lower damper is 190 $cm^2$.

Referring to FIGS. 9 and 10, this example will now be described.

FIG. 9 shows an example that the packaging box 1 drops upside down and the upper surface of the packaging box 1 receives impact. FIG. 9 shows impact values determined, in which the packaging box 1 dropped from the height of 1 m and 1.5 m and the area of the opening 8 centered relative to the upper damper 3 is 300 $cm^2$ and 570 $cm^2$. As can be seen from the test result in FIG. 9, when the area of the opening 8 is 570 $cm^2$, the impact is smaller.

FIG. 10 shows an example that the packaging box 1 drops as it is (not upside down) and the bottom of the packaging box 1 receives impact. FIG. 10 shows impact values determined, in which the packaging box 1 dropped from the height of 1 m and 1.5 m and the area of the opening 11 centered relative to the lower damper 2 is 100 $cm^2$ and 190 $cm^2$. As can be seen from the test result in FIG. 10, when the area of the opening 11 is 190 $cm^2$, the impact is smaller.

In this case, since the height h2 of upper impact-absorbing leg sections 7A is lower than the height h1 of the lower impact-absorbing leg sections 10A, when the area of the opening 8 of the upper damper 3 and the area of the opening 11 of the lower damper 2 are assumed to be the same, impact propagated to the container 5 when the upper surface of the packaging box 1 receives impact is larger than impact propagated to the container 5 when the lower surface of the packaging box 1 receives impact.

Therefore, by making the area of the opening 8 of the upper damper 3 larger than the area of the opening 11 of the lower damper 2, impact propagated to the container 5 is decreased when the upper surface of the packaging box 1 receives impact. This is because impact will be the same when the upper and lower surfaces of the packaging box 1 receive impact. Impact the upper and lower surfaces of the packaging box 1 receive may be the same as upper and lower surfaces or one of upper and lower surfaces may be larger. Therefore, it can be determined adequately in accordance with the various conditions.

A drop test will now be described, the test being performed using a damper system for transportation according to the present invention and a known damper system for transportation. In the test, containers each containing 25 semiconductor silicon wafers with a diameter of 300 mm were each placed in corresponding packaging boxes made of a corrugated fiberboard, and the packaging boxes were sealed with staples or strips of adhesive tape.

Figure 7:
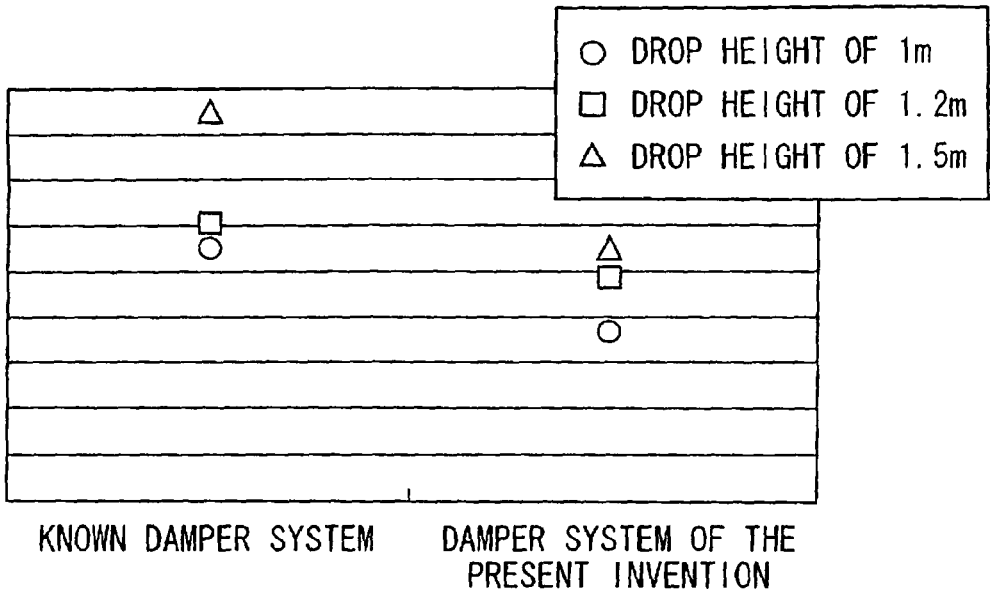
FIG. 7 is a graph showing impact values determined in a drop test in which the height of lower impact-absorbing sections and the drop height are varied.
Figure 8:
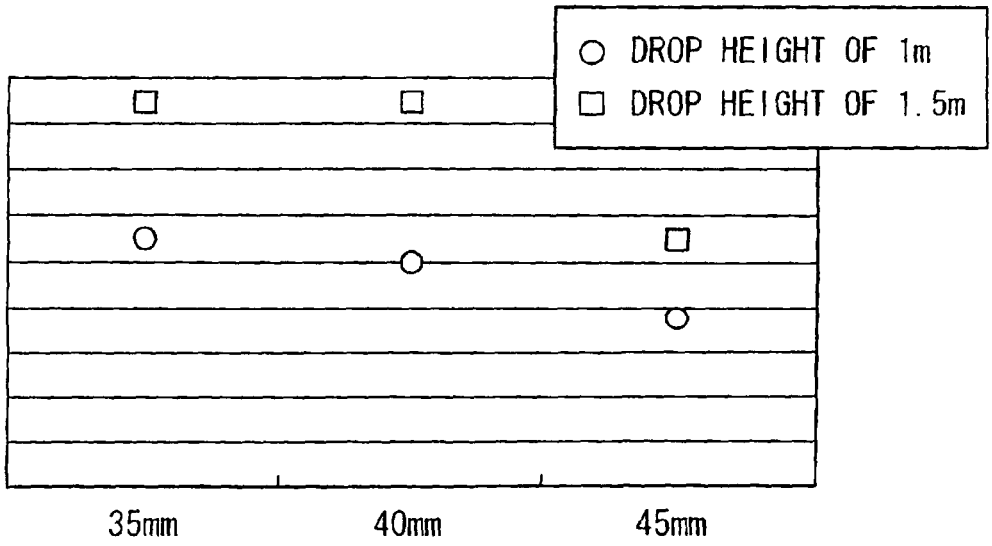
FIG. 8 is a graph showing impact values determined in a drop test in which the drop height is varied.

FIG. 7 shows impact values determined in a first experiment, in which the drop height is 1, 1.2, or 1.5 m, lower dampers and upper dampers are made of foamed polyethylene expanded by 30 times, and the height of lower impact-absorbing leg sections 10A is 4.5 cm. FIG. 8 shows impact values determined in a second experiment, in which the height of the lower impact-absorbing leg sections 10A is 3.5, 4.0, or 4.5 cm and the drop height is 1 or 1.5 m. Conditions such as the number of the stored semiconductor silicon wafers and the material of the dampers are common to the first and second experiments.

As is clear from FIGS. 7 and 8, the damper system of the present invention more effectively absorbs impact as compared with the known damper system. Therefore, the silicon wafers placed in the container are prevented from being damaged.

As described above, a damper system of the present invention absorbs impact applied in the upper, lower, right, left, front, or back direction if the system includes a packaging box with a predetermined size. In particular, the damper system absorbs a strong impact applied to the system in the lower direction. Thus, semiconductor silicon wafers that have a large diameter and are therefore very expensive can be prevented from being chipped or cracked and can be transported safely and securely.

Examples of a material for forming the lower and upper dampers 2 and 3 include foamed polyethylene, which is used in the test described below, and polypropylene.

And if the h1, the height of the upper impact-absorbing leg sections 7A of the lower damper 2, is set within the range of 4 to 5 cm, the same function and effect as above-described embodiment can be obtained. In addition, the h2, the height of the lower impact-absorbing leg section 10A of the upper damper 3, is set within the range of 0.5 to 1.5 cm, the same function and effect as above-described embodiment can be also obtained.

The packaging box 1 and the container 5 each have a predetermined size and the size is not varied; hence, the width of spaces therebetween is not varied. Therefore, the sum of h1 and h2 is equal to the width of a lower or upper space between the packaging box 1 and the container 5.

Besides it, if the percentage of the Sb, the area of each of the contact portions, to the Sa, the area of the upper or lower face of the packaging box 1, is set within the range of 3 to 5%, the same function and effect as above-described embodiment can be also obtained.

Figure 11:
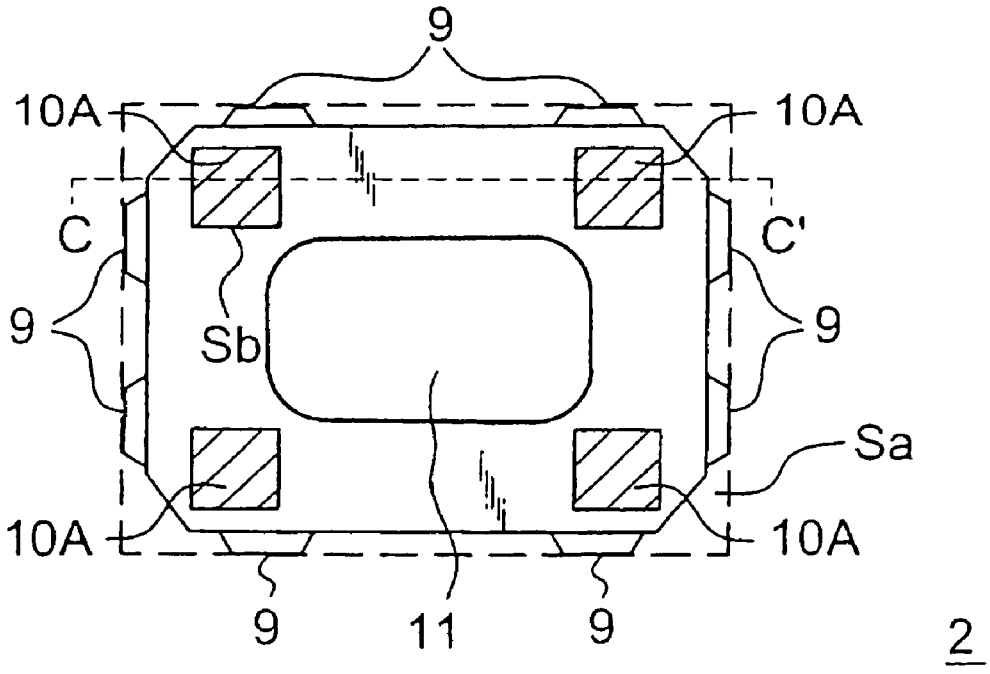
FIG. 11 is a plan view showing a modification of the invention.

In the above mentioned embodiment, the size of the opening 8 is set to be larger than the distance between two upper impact-absorbing leg sections 7A. However, the openings 8 and 11 are determined adequately in relation to demanding the impact-absorbing ability and the lengths of leg sections. In FIG. 2, the opening 8 is set to be longer in the longitudinal direction (vertical direction in FIG. 2) and be larger than the distance between two upper impact-absorbing leg sections 7A. However, the opening 8 may be set to be longer in the lateral direction (horizontal direction in FIG. 2) and larger than the distance between two upper impact-absorbing leg sections 7A. In addition, in FIG. 3, the size of the opening 11 is set to be smaller than the distance between two lower impact-absorbing leg sections 10A in relation to the opening 8. However, as shown in FIG. 11, the opening 11 may be set to be longer in the lateral direction and larger than the distance between two upper impact-absorbing leg sections 10A. Moreover, the opening 11 may be set to be longer in the longitudinal direction.

The larger the opening 8 and 11, the larger the impact-absorbing ability. When the opening 8 and 11 are larger than the distance between leg sections 7A and 10A, the impact-absorbing ability is much better. This is because an increase in the size of the openings 8 and 11 decreases the area of supporting the container 5 and also decrease the power of supporting the container 5. In this condition, when impact is applied from outside, the container 5 deforms the opening 8 and 11 under its own weight and absorbs the impact by a phenomenon that the container 5 is slightly fitted in the opening 8 and 11.

Therefore, in accordance with the impact-absorbing ability required for the entire packaging box 1 or the impact-absorbing ability required for the upper and lower surfaces of the packaging box 1, the size of the openings 8 and 11 and the length of leg sections 7A and 10*a* are determined.

Further, it is preferable that the area of the opening 8 of the upper damper 3 is set to be 2.5 to 3.5 times as much as the area of the opening 11 of the lower damper 2. This magnification relates to the length of the leg sections 7A and 10A. As mentioned above, when the height h1 of the impact-absorbing leg sections 7A is 4 cm to 5 cm and the height h2 of the impact-absorbing leg sections 10A of the upper damper 3 is 0.5 cm to 1.5 cm, the area ratio of the openings 8 and 11 is set to be 2.5 to 3.5 times. As a result, the impact-absorbing ability of the upper and lower surface of the packaging box 1 can be equal. Further, in order to increase the impact-absorbing ability of the upper surface, the area of the opening 8 of the upper damper 3 needs to be increased and the height of the impact-absorbing leg sections 7A needs to be increased. When in order to increase the impact-absorbing ability of the lower surface, the area of the opening 11 of the lower damper 2 needs to be increased and the height of the impact-absorbing leg sections 10A needs to be increased.

What is claimed is:

1. A damper system, for transportation of a container, comprising:

a packaging box storing a container containing work products in a vertical state to be protected from damage upon impact;

a lower damper, located in a lower space between lower surfaces of the packaging box and container, the lower damper having a lower body portion and lower impact-absorbing leg sections, wherein the lower body portion has upper and lower surfaces and four side surfaces defining four corners of the lower body portion and wherein the lower impact-absorbing leg sections are respectively located at the four corners of the lower body portion and extend a distance h1 from the lower surface of the lower body portion toward the lower surface of the packaging box; and an upper damper, located in an upper space between upper surfaces of the packaging box and container, the upper damper having an upper body portion and upper impact-absorbing leg sections, wherein the upper body portion has upper and lower surfaces and four side surfaces defining four corners of the upper body portion and wherein the upper impact-absorbing leg sections are respectively located at the four corners of the upper body portion and extend a distance h2 from the upper surface of the upper body portion toward the upper surface of the packaging box; and wherein h1 is greater than h2 and the lower damper has an opening, which penetrates through the lower damper, for distributing impact, applied from the outside, to the lower impact-absorbing leg sections, the opening being centered relative to the lower damper, the upper damper has an opening, which penetrates through the upper damper, for distributing impact, applied from the outside, to the upper impact-absorbing leg sections, the opening being centered relative to the upper damper, and the area of the opening centered relative to the upper damper is larger than the area of the opening centered relative to the lower damper.

2. The damper system according to claim 1, wherein the height h1 of the impact-absorbing leg sections of the lower damper system is within a range of 4 to 5 cm and the height h2 of impact-absorbing leg sections of the upper damper system is within a range of 0.5 to 1.5 cm.

3. The damper system according to claim 1, wherein the lower impact-absorbing leg sections of the lower damper system have a rectangular parallelepiped shape.

4. The damper system according to claim 1, wherein the upper and lower surfaces of the packaging box have a surface area Sa, wherein the lower impact-absorbing leg sections contact the lower surface of the packaging box or the upper impact-absorbing leg sections contact the upper surface of the packaging box over a total area of contact Sb, and wherein Sb is 3%-5% Sa.

5. The damper system according to claim 1 wherein the opening has a cross-section defined by four interior side walls respectively parallel to the four side surfaces of the lower damper, and wherein a dimension of the rectangle, extending between two of the interior side walls opposing each other, is greater than the distance on the lower surface of the lower damper between two of the leg sections on the lower damper.

6. The damper system according to claim 1 wherein the opening has a cross-section defined by four interior side walls respectively parallel to the four side surfaces of the upper damper, and wherein a dimension of the rectangle, extending between two of the interior side walls opposing each other, is greater than the distance on the upper surface of the lower damper between two of the leg sections on the upper damper.

7. The damper system according to claim 1 wherein the area of the opening centered relative to the upper damper is set to 2.5 to 3.5 times as much as the area of the opening centered relative to the lower damper.

* * * * *